United States Patent [19]

Rabold

[11] Patent Number: 5,000,456

[45] **Date of Patent: * Mar. 19, 1991**

[54] MEANS AND METHOD FOR TEACHING AND PRACTICING A CONNECTED GOLF SWING

[76] Inventor: Bill Rabold, P.O. Box 854, Bellaire, Mich. 49615

[ * ] Notice: The portion of the term of this patent subsequent to Mar. 27, 2007 has been disclaimed.

[21] Appl. No.: 469,772

[22] Filed: Jan. 23, 1990

Related U.S. Application Data

[63] Continuation of Ser. No. 314,405, Feb. 22, 1989, Pat. No. 4,911,450.

[51] Int. Cl.[5] ..... A63B 69/36

[52] U.S. Cl. ..... 273/186 A; 273/167 A; 273/192; 273/194 A

[58] Field of Search ..... 273/186 AA, 186 A, 186 R, 273/186 C, 186 D, 167 A, 192, 194 A

[56] References Cited

U.S. PATENT DOCUMENTS 3,677,553 7/1972 Moore ..... 273/186 A
4,108,441 8/1978 Tredway ..... 273/186 A
4,693,479 9/1987 McGwire ..... 273/186 A

FOREIGN PATENT DOCUMENTS 523707 7/1940 United Kingdom ..... 273/186 A

*Primary Examiner*—Benjamin Layno
*Attorney, Agent, or Firm*—Terry M. Gernstein

[57] ABSTRACT

A device used to teach and practive a connected golf swing includes a short shaft having a clubhead on one end and a grip on the other end. A grip end light is mounted in the grip to produce a light that is co-linear with the longitudinal axis of the shaft. A clubhead light is mounted in the clubhead to provide a light that is directly below the clubhead bottom edge and which is oriented at 90° to the bottom edge of the clubhead so that the clubhead light is located directly beneath the clubhead. A swing track includes paths to be traversed by the grip end light and the clubhead light during the various phases of the golf swing. Locating the clubhead light directly beneath the clubhead bottom edge keeps the golfer's eyes focused directly on the clubhead and thus tends to keep the golfer's hands, arms and body operating as a connected synchronized unit.

19 Claims, 3 Drawing Sheets

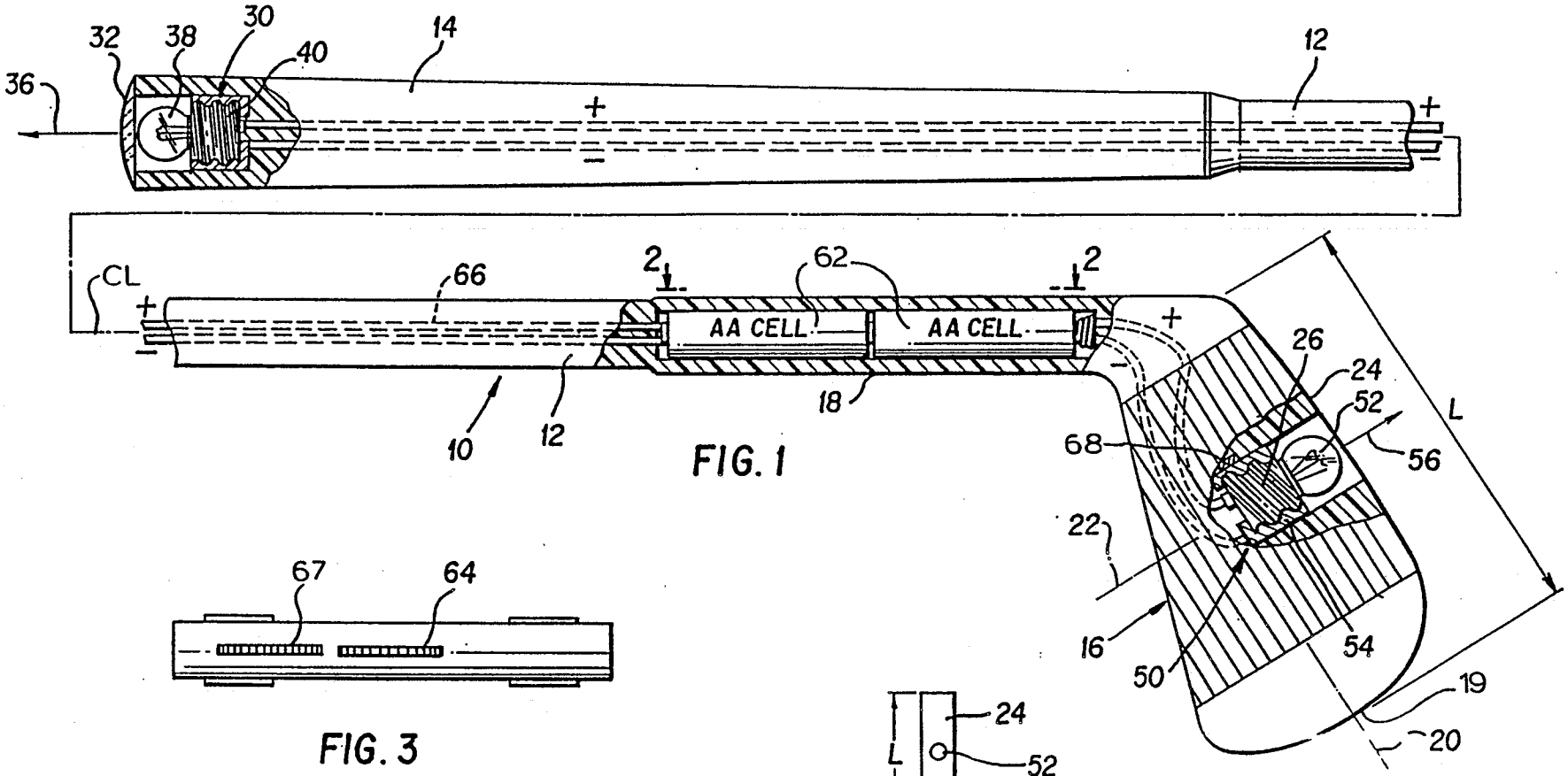
FIG. 1
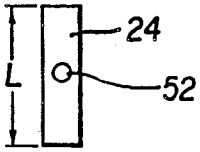
FIG. 2
FIG. 3

FULL HARD SWING

MEANS AND METHOD FOR TEACHING AND PRACTICING A CONNECTED GOLF SWING

This is a continuation of copending application Ser. No. 07/314,405 filed on 02/22/89 now U.S. Pat. No. 4,911,140.

TECHNICAL FIELD OF THE INVENTION

The present invention relates to the general art of sport training devices, and to the particular field of teaching and practicing a golf swing.

BACKGROUND OF THE INVENTION

The popularity of golf is well documented in the United States, and its popularity is nearly legendary in other countries, such as Japan. Golfers' skills vary from high-scoring duffers to tournament-winning professionals, yet no golfer ever gets so consistently good that he can't benefit from some constructive training and/or practice. Even the great Bobby Jones usually had an advisor accompanying him on tour to keep his swing proper.

Accordingly, the field of golf teaching and practicing has exploded with a plethora of golf teaching and/or training aids and devices which range from textbooks written by professionals to equipment such as practice clubs.

To facilitate teaching and learning the golf swing, such swing has been divided into several phases: address or set-up is the position which the golfer initially assumes in relation to the ball with the clubhead located behind the ball before hitting a shot; the backswing is the phase of the overall swing in which the club is drawn back into a cocked position; the downswing is the phase of the overall swing in which the club is moved toward and into contact with the ball; and the follow-through is the phase of the overall swing in which the club is moved past and beyond the hitting zone to finish the swing.

It is extremely important to keep the arms, hands and upper body in synch and moving as a unit during the entire swing from set-up to finish. This unitary movement of the hands, arms and body s referred to as "connection" by textbooks, such as "How to Perfect your Golf Swing" by J. Ballard, published by golf Digest/-Tennis Inc., in 1981. In particular, at pages 23, 29, 42, 57–58, 60, 77–87 and 119–141 (the disclosure of which is incorporated herein by reference), this text discusses the importance of maintaining such connection throughout the entire swing. If the unit is disconnected, accuracy, power, distance and consistency will be vitiated, if not entirely lost.

Concomitant to the requirement for connection, the club face must be square to the line of flight at impact or the ball will fly off line.

In a golf swing, as in any other sports stroke, it is critical that the golfer receive and retain an accurate picture in his mind of the basic moves involved in the swing. Any practice move which is repeated by a golfer is going to register in his mind as a form of "muscle memory". Therefore, the golfer, in order to program the correct set-up, backswing, downswing and follow-through, must be able to visually appreciate those moves so that his muscle memory is accurate and repeatable.

Likewise, any error in the practice movement will be repeated in the actual swing. In other words, "practice makes permanent".

Therefore, it is extremely important for any practice device or technique to be designed to promote proper habits, including maintaining connection and ensuring that the club face will be square to the desired line of flight at the moment of impact between that club face and the ball.

While all practice and/or teaching devices, in theory, propound correctness, not all such devices actually, in practical application, provide such correctness.

In particular, the above-discussed connection is not always produced. In fact, devices such as disclosed by S. J. Perkins in U.S. Pat. No. 4,456,257, have been found to actually promote disconnection.

Specifically, referring to FIGS. 1, 3 and 4 of the Perkins patent, it is seen that the guiding light is focused either to the side of the ball at impact (FIG. 1) or in front of the ball at impact (FIGS. 3 and 4). The target is thus disconnected from the clubhead. This target/clubhead disconnection causes the golfer to visually begin the swing and to hit the ball, looking at a light that is not in the proper position. This off-line guide causes the golfer to have a tendency to move the clubface toward a spot to the light thereby actually forcing his hands and arms away from his body. The off-line light of the Perkins device thus actually promotes disconnection in the swing at set-up, impact and follow-through. From a disconnected orientation established in set-up, the backswing has been found to be disconnected and the downswing has been likewise disconnected. Such disconnection has also been found to move the backswing out of the proper plane.

The off-line orientation of the Perkins device has also been found to promote disconnection during the follow-through phase of the swing. The off-line target provided by the Perkins device has been found to actually cause the golfer to swing the club in a manner that moves his hands away from his body, thereby actually promoting a disconnection in his swing.

Still further, because of the off-line orientation of the Perkins device, it has been found that the golfer actually is encouraged to and tends to move his hands and arms in a manner that causes the club face to strike the ball in a non-square orientation with respect to the desired flight path.

Accordingly, there is a need for a golf swing teaching/practice aid which, in practical application, promotes a swing that is connected throughout the entire swing, and further promotes a swing that has the clubhead square to the flight path at impact.

Still further, since practice is so important in establishing a proper golf swing, any device or technique used should encourage as much practice as possible. However, full size golf clubs, such as used in the Perkins device, cannot be used indoors, and thus deprive the golfer of valuable practice time. Still further, such full size devices are inconvenient to store and transport, again, possibly depriving the golfer of valuable practice time.

Accordingly, there is a need for a device that not only promotes a proper golf swing, but which is also amendable to indoor practice and which is easily stored and transported.

OBJECTS OF THE INVENTION

It is a main object of the present invention to provide a means and a method for teaching a golf swing that is, in practical application, proper.

It is another object of the present invention to provide a means and a method for teaching a golf swing that is connected.

It is another object of the present invention to provide a means and a method for teaching a golf swing that is connected and which has the club face square to the desired line of flight at impact.

It is another object of the present invention to provide a means and a method for teaching a golf swing that is connected and which can be used indoors.

It is another object of the present invention to provide a means and a method for teaching a golf swing that is connected and which includes a practice device that is easily stored and transported.

SUMMARY OF THE INVENTION

These, and other, objects are achieved by a practice device that includes a shaft that is much shorter than a regulation golf club shaft and which has a grip on one end and a clubhead on the other end. The device further includes a grip end light which directs a beam of light co-linearly with the longitudinal axis of the shaft and a clubhead light that is mounted on the bottom of the clubhead and is oriented at 90° to the lower edge of that clubhead in the middle of the clubhead to provide a target that is positioned directly beneath the clubhead in the set-up and impact phases of the swing. Locating the target directly beneath the clubhead keeps the golfer's swing connected from set-up to finish.

By focusing the target beneath the clubhead, the golfer will tend to keep his swing connected rather than be encouraged to disconnect by having a target disconnected from the clubhead. By having a target directly beneath the clubhead, the eyes of the golfer focus on the clubhead itself, rather than on an area spaced from the clubhead, thereby permitting the golfer to not only keep his swing connected throughout the entire swing, but to also keep the clubface square at impact.

The device of the present invention is much shorter than a full size golf club, for example, an adult model will have a shaft that is no longer than about 25" or so, and thus the device can be easily used in doors, stored and transported. Yet the device is weighted to be swung and to produce the feel of a actual, full size golf club.

The present invention also includes a method of teaching and practicing a connected golf swing using the above-described device. The method of teaching and practicing includes the use of various swing tracks which are located to be followed by the lights of the device. The path traveled by the clubhead will thus be accurate, and the golfer will focus on a target that keeps is swing connected by being directly beneath the clubhead instead of at an angle or spaced from such clubhead.

Visually, using the device of the present invention, the golfer will be able to discern exactly where the clubhead is at all times, thus if any corrections need to be made, they can be easily made with full assurance that they are correct, thus allowing the golfer to be positively re-enforced with the proper moves.

The connected swing encouraged by the device and method of the present invention allows the golfer to continue to accelerate through the ball, and allows the proper rotation of the hands so that there is a full extension of the arms traveling down the intended ball flight line. Since there is no angling or displacement of the target, there is no disconnection-encouraging target in the present device. Contrary to this, the target actually is connected with the device as much as possible so that the connection is encouraged.

The device of the present invention actually promotes connection because one light is 90° to the bottom of the club. With the light in such position, as the golfer follows through, he will visually discern if the club is in fact traveling down the intended ball flight line. If there is an error as to where the clubhead is traveling, the golfer will immediately make the necessary adjustments. Because the present device encourages the golfer to stay connected throughout the entire swing, the golfer will achieve longer, more accurate shots because his swing is fundamentally correct from start to finish.

The present device promotes the formation of a correct mental picture of the golf swing, thereby promoting a proper muscle memory so that practice will, indeed, make perfect.

DESCRIPTION OF THE DRAWINGS

FIG. 1 shows the device embodying the present invention.

FIG. 2 shows the bottom edge of the clubhead used in the device of the present invention.

FIG. 3 is a cover used on the device of the present invention.

DETAILED DESCRIPTION OF THE PREFERRED EMBODIMENT OF THE INVENTION

Figure 4:
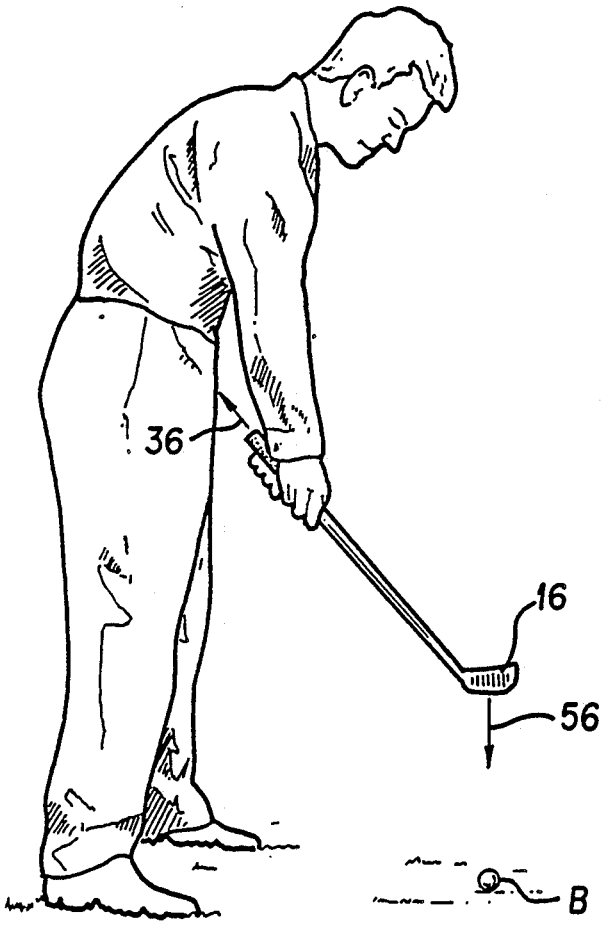
FIG. 4 shows a golfer in the set-up phase of his swing using the device of the present invention.

Shown in FIG. 1 is a device 10 embodying the present invention. The device 10 has the same general appearance of a golf club; however, it is much shorter than a normal golf club, and is made of plastic or like material as it is not designed to actually hit a golf ball. The overall length of the device 10 can be, for example, no greater than about 25–30" for an adult device, and commensurately short for a child's device.

The device 10 includes a shaft 12 having a longitudinal axis CL and a grip 14 on one end of the shaft and a clubhead 16 on the other end of the shaft. The shaft will be approximately 25–27" long for an adult device in the preferred embodiment. The clubhead also includes a hosel 18 and a toe 19 and has an length L as measured between the hosel and the toe. The clubhead also includes a central longitudinal axis 20 oriented at a suitable angle with respect to the shaft longitudinal axis CL and a transverse axis 22. The clubhead 14 further includes a lower edge 24 and is weighted to include a sweet spot, generally indicated in FIG. 1 at 26.

The grip 14 includes a light 30 mounted in the top 32 of the grip to direct a beam of light 36 co-linearly with the shaft longitudinal axis CL. The light 30 includes a light bulb 38 threadably mounted in a base 40 and includes collimating means (not shown) or the like so that the beam of light 36 is clear and precisely defined. The purpose of such precise definition of the light beam 36 will be apparent to those skilled in the art based on the teaching of the present disclosure, and the means to effect such function will also be apparent to those skilled in the art.

The device 10 also includes a light 50 mounted in the clubhead 16. The light 50 includes a light bulb 52 threadably mounted in a base 54. The bulb 50 is mounted essentially centrally of the clubhead bottom edge as measured between the hosel and the toe and is oriented to produce a beam of light 56 that is directed at 90° to the bottom edge 24 of the clubhead and to be directly beneath that clubhead bottom edge. Preferably, the light bulb 52 is located so that the beam of light 56 is also located beneath the sweet spot 26.

Referring to FIG. 2, which shows the bottom edge of the clubhead, it is seen that the light bulb 52 is centrally located in the clubhead to direct the beam of light out of the bottom edge 24 of the clubhead.

As above discussed, locating the light 50 to direct the beam of light 56 directly out of the bottom edge of the clubhead at a 90° angle to that bottom edge causes the golfer to maintain his swing connected from start to finish by keeping his eyes focused on a target that is located directly beneath the central location of the clubhead as opposed to a target that is located at a location that is spaced from such central location, either toward the shaft or in front of the clubhead.

The device 10 further includes a light actuating system that includes batteries 62 removably mounted in the shaft, an on/off switch 64 (see FIG. 3) also mounted on the shaft, and leads, such as lead 66, connecting the batteries to the lights via the switch 64. Actuation of the switch actuates both of the lights to produce beams 36 and 56. The batteries are located near the hosel to provide weight to the device so that device has the balance and feel of an actual, full size, golf club. However, the batteries can be located at any selected location in the device, such as in the grip, or the like. Furthermore, beams 36 and 56 can be generated from separate and independent systems that are actuated by individual switches such as switch 67, and can include separate batteries if suitable. The leads 66 can be connected to the switches 64 and 67 and to the batteries 67' and 67'' so that the lights will be part of individual circuits, each having its own actuating means, it own leads and its own battery so that the grip light and the clubhead light are independent of each other and can be operated individually of each other. The circuit connection of each battery to each light via a switch is a simple series dc circuit and is well known to those skilled in the art of electronic circuits. Further weights can be added to the clubhead, as indicated at 68 to further ensure the correctness of the weight and balance of the device.

Figure 5:
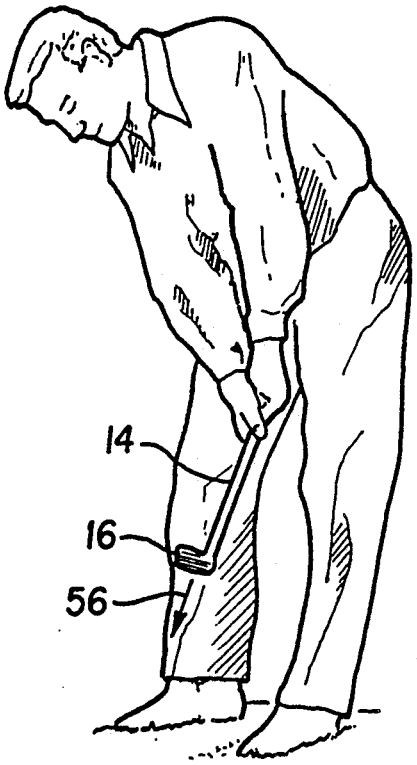
FIG. 5 shows a golfer in the impact phase of his golf swing using the device of the present invention.

Referring to FIGS. 4 and 5, it is seen that the device 10 is held and swung exactly like a full size club. For the sake of completeness, the device is shown in FIG. 4 and 5 to be a wood; whereas the device in FIGS. 1–3 is shown to be an iron. The device is shown in the set-up position in FIG. 4 with the light beam 56 directed out of the bottom edge of the clubhead to the ball B and the light beam 36 directed upwards toward the golfer's body. Since the light beam 56 emanates directly from the bottom edge of the clubhead, it targets the ball located directly beneath the bottom edge of the device rather than some area spaced from the ball or spaced from directly beneath the bottom edge of the device, and thus causes the golfer to focus his eyes directly on the ball. This immediately connects the golfer's swing from the very beginning.

The device is shown in FIG. 5 just after impact, and it is seen that directing the beam of light 56 directly out of the bottom of the clubhead at a 90° angle with respect to that clubhead bottom will cause that beam of light to contact the ball just as soon as the sweet spot of the club contacts the ball. This will create a target for the golfer's eyes that focuses directly on the actual target, the ball. Again, such coupling of the actual target with the light beam causes the golfer to keep his eyes coupled to the clubhead, thereby keeping the golf swing connected.

Figure 7:
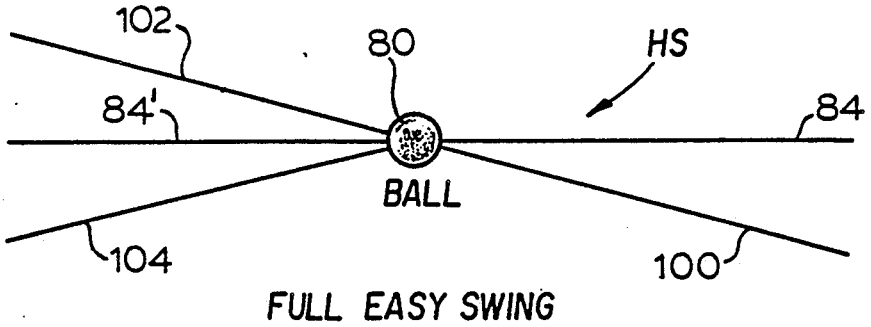
FIG. 7 is a schematic of a swing track for teaching and practicing a full easy swing using the method of the present invention.
Figure 6:
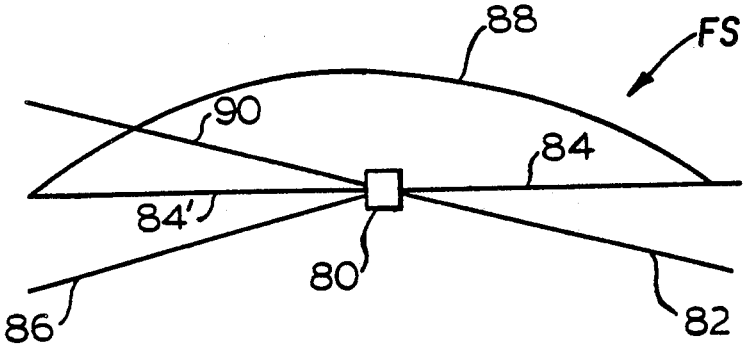
FIG. 6 is a schematic of a swing track for teaching and practicing a full hard swing using the method of the present invention.

Swing tracks FS and HS are shown in FIGS. 6 and 7, respectively. The swing track FS is used for teaching and practicing a full hard swing, and the swing track HS is used for teaching and practicing a full easy swing.

As shown in FIG. 6, swing track FS includes a ball location indicator 60 which is addressed during set-up in the same manner as an actual golf swing, with the indicator 60 occupying the position shown in FIG. 4 for the ball B. The light beam 56 is pointed directly at the location 60 during this set-up phase of the swing in the manner of the address shown in FIG. 4. The swing track FS includes a path 62 which is traversed by both the light beams 56 and 36 in order during the backswing phase of the swing, with beam 56 leading, and beam 36 following when the device is moved as the golfer's shoulders and body are appropriately rotated during the backswing phase.

Since the beam 56 is directly below the clubhead, the golfer will keep his eyes on the exact path being followed by the clubhead, and thus will keep his swing connected during the backswing phase.

The track FS further includes a ball flight line 64 which intersects and extends on both sides of the ball location 60, with path 64' being on the forward portion of the path, that is, the path to be followed by the ball after impact. A proper swing will keep the clubhead light 56 focused on the ball flight line 64'.

The swing track FS further includes a follow-through path 66 which is traversed by the grip end light beam 36 during an easy swing, and a path 68 which is traversed by the grip end light beam 36 during a hard swing. Using paths 66 and 68, a golfer can learn the feel of several different types of swing, thereby increasing his feel for the overall swing. However, due to the location of the light beam 56 directly beneath and at 90° to the bottom edge of the clubhead, the golfer's hands, arms and body will remain connected during the follow-through phase, just as they were during the set-up, backswing and downswing phases of the overall swing.

The swing track FS further includes a path 70 which is traversed by the grip end light beam 36 during the backswing phase of the swing.

As shown in FIG. 7, the swing track HS includes a ball location 60 which is addressed as discussed above, and a ball flight line 64 and 64' which is oriented and positioned as above discussed. The swing track HS further includes a path 80 which is traversed by both light beams 36 and 56 in turn during the backswing and a downswing phases of the overall golf swing. The swing track HS further includes a path 82 which is traversed by the grip end light beam 36 during the back swing and the downswing phase of the swing, and a path 84 which is traversed by the grip end light beam 36 during a follow through phase of the easy swing.

As will be evident to those skilled in the art, the device is best used in a darkened room so that the light beams can be seen; however, if the beams are extremely bright, such darkening of the room will not be necessary. Still further, if the light beams 36 and 56 are replaced by other types of beams, the swing track paths can be sensitized or contain suitable electronics so that alarms or the like will be actuated if the light beams move off of the track paths.

It is to be understood that while certain forms of the present invention have been illustrated and described herein, it is not to be limited to the specific forms or arrangement of parts described and shown.

I claim:

1. A device for teaching and practicing a proper golf swing comprising:

(A) a shaft having a longitudinal axis;

(B) a grip on one end of said shaft;

(C) a clubhead on another end of said shaft, said clubhead having a heel, a toe, and a bottom edge;

(D) a grip end light in said grip, said grip end light being mounted to direct a beam of light co-linearly with said shaft longitudinal axis;

(E) a clubhead light in said clubhead, said clubhead light being mounted centrally of said clubhead bottom edge between the heel and the toe and oriented on said clubhead to direct a beam of light at 90° to said clubhead bottom edge and being mounted to direct said beam of light directly out of said clubhead bottom edge to be located directly beneath said clubhead.

2. The device defined in claim 1 further including a sweet spot on said clubhead, with said clubhead light being mounted to direct a beam of light directly beneath said sweet spot.

3. The device defined in claim 1 wherein said short shaft is less than 28" long.

4. The device defined in claim 3 further including an actuating means for actuating said grip end light and said clubhead light.

5. The device defined in claim 4 wherein said actuating means includes a battery in said shaft, a switch on said shaft and leads connecting said battery to said grip end light and to said clubhead light via said switch.

6. The device defined in claim 5 further including weights in said clubhead.

7. The device defined in claim 5 wherein said battery is located adjacent to said clubhead.

8. The device defined in claim 4 wherein said device is formed of plastic material.

9. The device defined in claim 1 wherein said grip end light and said clubhead light are independent of each other and each includes its own actuating means that is independent of the other actuating means, with each actuating means including a switch, a battery and means for connecting said switch, said battery and the associated one of said lights.

10. The device defined in claim 9 wherein said clubhead light and said grip end light are removably mounted on said shaft and said clubhead respectively.

11. The device defined in claim 9 wherein said grip end light battery is located near said grip.

12. A method of teaching and practicing a proper golf swing comprising:

(A) providing a device as defined in claim 1;

(B) providing a swing track which includes a backswing path and a ball location indicating means;

(C) addressing said ball location indicating means during a set-up phase of a golf swing;

(D) executing a backswing phase of a golf swing;

(E) tracing the backswing path in a first direction with the clubhead light beam during said backswing phase;

(F) tracing the backswing path with the grip end light beam in the first direction during the backswing phase of the golf swing;

(G) executing a downswing phase of the golf swing;

(H) tracing the backswing path with the grip end light in a second direction that is opposite to the first direction during the downswing phase of the golf swing;

(I) tracing the backswing path with the clubhead light in the second direction during the downswing phase of the golf swing;

(J) maintaining the golfer's hands, arms and body connected and operating as a synchronized unit during the set-up, backswing and downswing phases of the golf swing.

13. The method defined in claim 12 further including providing a follow-through path in said swing track.

14. The method defined in claim 13 further including executing a follow-through phase of the golf swing.

15. The method defined in claim 14 further including maintaining the golfer's hands, arms and body connected and operating as a synchronized unit during said follow-through phase of the golf swing.

16. The method defined in claim 15 further including tracing the follow-through path with the grip end light during said follow-through phase of the golf swing.

17. The method defined in claim 15 further including providing a second follow-through path on the swing track.

18. The method defined in claim 17 further including tracing said second follow-through path with the clubhead light during said follow-through phase of the golf swing.

19. The method defined in claim 17 further including providing a third follow-through path on the swing track and tracing said third follow-through path with the grip end light during a follow-through phase of the golf swing.

* * * * *